US007394211B1

(12) United States Patent
Kuhlmann

(10) Patent No.: US 7,394,211 B1
(45) Date of Patent: Jul. 1, 2008

(54) STEP DOWN POWER MANAGEMENT SYSTEM FOR LED FLASHLIGHT

(75) Inventor: Kurt Kuhlmann, San Jose, CA (US)

(73) Assignee: Laughing Rabbit, Inc., Blachly, OR (US)

( * ) Notice: Subject to any disclaimer, the term of this patent is extended or adjusted under 35 U.S.C. 154(b) by 0 days.

(21) Appl. No.: 11/700,727

(22) Filed: Jan. 30, 2007

(51) Int. Cl.
*H05B 37/02* (2006.01)

(52) U.S. Cl. ..... 315/291; 315/224; 315/362

(58) Field of Classification Search ..... 315/209 R, 315/224, 225, 291, 307–308, 362; 327/175, 327/514–515, 540; 323/222, 265, 299
See application file for complete search history.

(56) References Cited

U.S. PATENT DOCUMENTS 4,673,865 A * 6/1987 DeLuca et al. ..... 323/222
5,736,881 A * 4/1998 Ortiz ..... 327/175
5,739,639 A * 4/1998 Johnson ..... 315/86
6,305,818 B1 * 10/2001 Lebens et al. ..... 362/184
6,320,330 B1 * 11/2001 Haavisto et al. ..... 315/291
6,888,383 B1 * 5/2005 Fairbanks ..... 327/124
7,015,654 B1 * 3/2006 Kuhlmann et al. ..... 315/291
7,071,630 B1 * 7/2006 York ..... 315/224
2005/0057187 A1 * 3/2005 Catalano ..... 315/291

* cited by examiner

*Primary Examiner*—Thuy V. Tran
*Assistant Examiner*—Tung X Le
(74) *Attorney, Agent, or Firm*—Black Lowe & Graham PLLC

(57) ABSTRACT

A micro-controller and a converter circuit provide constant current to light emitting diode array from a power supply with greater voltage than the forward bias voltage of the light emitting diode. A micro-controller operatively coupled with a semiconductor switch and the converter circuit measures the ability of a DC power supply to charge the inductor. Duty cycles of the semiconductor switch are modified according to the measurement of the voltage across the internal resistor of the semiconductor switch so as to supply substantially constant current to the LED array through an inductor regardless of actual battery voltage.

9 Claims, 5 Drawing Sheets

STEP DOWN POWER MANAGEMENT SYSTEM FOR LED FLASHLIGHT

TECHNICAL FIELD

The invention generally relates to portable illumination devices. More specifically, the invention relates to personal, handheld flashlights having a self-contained direct current power supply and one or more light emitting diodes as a light source.

BACKGROUND OF THE INVENTION

Technology relating to handheld flashlights incorporating a direct current power supply in the form of replaceable batteries and low voltage, incandescent bulbs achieved a technological plateau in the 1970's. Advances in the state of the art typically related to methods of packaging the batteries and bulbs, and reflector designs. In particular, the capabilities of flashlights of this type are strictly limited by inherent characteristics of the incandescent bulb itself. Initially, evacuated bulbs using tungsten filaments enabled power supplies in the range of 1.3V (and more when such batteries are connected in series) to provide varying levels of illumination. So-called halogen bulbs permitted higher filament temperatures increasing the output of such flashlights. Nevertheless, the inherent inefficiency of incandescent bulbs limited the duration of operation of such flashlights to a matter of a few hours or less depending on the number of dry cells provided in the power supply. That is, for increased run time the batteries could be connected in parallel. For increased light intensity, the batteries could be connected in series (for increased voltage) but at the expense of run time. In addition, filament bulbs are highly susceptible to mechanical shock, breaking the filament and rendering the flashlight inoperative. In addition, substantial development effort was directed to switch mechanisms for intermittently connecting the direct current power supply to the incandescent bulb so as to render either a more reliable or inexpensive switch, or both.

U.S. Pat. No. 4,242,724 to Stone is believed to be representative of one evolutionary branch of such technology relating to the packaging of a disposable floating flashlight in which the outer casing of the light itself forms a part of the switch mechanism which, when squeezed, completes electrical continuity between two AA (1.3V each) batteries and an incandescent bulb. The flashlight is compact, and floats if accidentally dropped into water. U.S. Pat. No. 5,134,558 to Williams et al. discloses a different evolutionary branch in which the light output from four AA-type batteries is boosted by an oscillator driven transformer rectifying circuit to an intermittent high voltage applied to a xenon gas flashtube so as to provide a high intensity emergency flasher. The device disclosed in Williams et al. delivers significantly more illumination from a direct current power supply than does the incandescent bulb type of flashlight disclosed by Stone. Nevertheless, the circuitry disclosed in Williams et al. for operating the xenon flashtube is expensive, bulky, and only suitable for intermittent operation of the flashtube rather than for providing a constant light output. Thus, the teachings of the prior art disclosed by Williams et al. is not suitable for remedying the inherent limitations of the incandescent bulb type flashlight technology disclosed by Stone.

As stated above, the fundamental limitations of prior art flashlights related to inherent limitations of incandescent bulb technology, and inherent limitations of electrical circuits for driving other light generating devices such as the xenon flashtube shown in Williams et al. Nevertheless, semiconductor technology contemporarily advanced so as to provide semiconductor devices, including light emitting diodes (hereinafter occasionally "LEDs") having significantly lower current drain than incandescent bulbs in a highly robust package operable at relatively low direct current voltages. In addition, early LEDs were substantially more power efficient than incandescent bulbs having similar current consumption characteristics. Finally, the small physical size of LEDs permitted extremely efficient packaging shapes to be adopted for such lights. U.S. Pat. No. 5,386,351 to Tabor discloses such a space efficient packaging design for a single LED flashlight. The Tabor patent discloses a two-part, snap-fit housing incorporating a discoid type battery in which one leg of a two terminal LED is employed as part of a cantilever spring switch mechanism which upon depression by a flexible button completes a direct current circuit to the LED. Unfortunately, such early stage LEDs could not provide significant light output without being driven at very high currents, in which case, the power efficiency of the LED with respect to the quantity of light produced significantly decreased. Also, LEDs in use during the period in which the Tabor patent application was filed were only capable of producing light in the red part of the visible spectrum. These two limitations resulted in an LED flashlight only having utility for intermittent operation or continuous illumination over short distances. Therefore, such personal flashlights could not supplant conventional incandescent bulb flashlights which have a more linear relationship with respect to supply voltage and current.

A high intensity incandescent bulb flashlight can be produced by merely increasing the amount of current and/or voltage supply to the bulb. Conventional LEDs, being nonlinear devices do not respond in such a linear fashion. Therefore, LEDs were often employed in lighting devices for alternative purposes, such as the color coded, multiple LED light and key device shown in U.S. Pat. No. 4,831,504 to Nishizawa et al. The Nishizawa et al. patent discloses a combination LED flashlight and key in which multiple LEDs having different colors are driven by separate, manual switches and/or a microprocessor to signal an appropriate light detecting and demodulating device in association with a door lock or operating lock. Similarly, International Patent Application No. WO 01/77575 A1 titled, "Portable Illumination Device" published on Oct. 18, 2001, to Allen discloses a unique product package for a single LED personal flashlight employing a discoid type battery in which multiple depressions of a switch incorporated into the product housing cycles the single LED through multiple modes according to instructions stored in a microprocessor within the housing. Neither the invention disclosed by Nishizawa et al. nor the invention disclosed by Allen is capable of substantially increasing the light output of the LED such that the lighting devices disclosed therein are adequate replacements for high intensity incandescent bulb flashlights. The principle reason for this is that light emitting diodes, being junction semiconductor devices, have a forward bias voltage which is predetermined by the physics of the semiconductor materials from which diodes are manufactured. The forward biased voltage of silicon-based light emitting diodes is approximately 3.6 V for aqua, blue, and white LEDs and 1.8 V for red, yellow, and green LEDs. The voltage-current characteristics of devices of this type are such that substantially increasing the applied voltage outside of a range defined by the forward bias voltage does not substantially increase the light output of the device, but merely results in vastly increased current flowing therethrough. The power output of a diode being equivalent to the product of the voltage applied thereto and the current flowing therethrough, higher voltages on the power supply side merely result in much higher current which results in wasted power without significant additional illumination. Thus, the light emitting diode can basically be characterized as a device having an optimal operating characteristic defined by a substantially constant current at a nearly fixed voltage. Therefore, the only efficient method for substantially increasing light output of a prior art LED device based on the silicon architecture is to provide multiple LEDs in parallel with the direct current voltage supply. Unfortunately, this arrangement only drains the typical (1.2, 1.5 or 3 V) battery supplies quickly until the batteries can no longer supply the forward bias voltage of the diodes. Placing the LEDs in series with the power supply merely exacerbates this problem. Thus, although the direct current power supply may be capable of providing additional current (i.e., the batteries are not fully discharged yet) the potentially depleted batteries cannot forward bias and thus illuminate the LEDs.

The semiconductor industry has recently addressed the above limitations of LEDs by providing white light LEDs based on indium-gallium-arsenic-phosphide architecture having forward bias voltages in excess of 3.6V. LEDs of this type not only provide a white light which is more effective than the red light of the prior art doped silicon technology but also produced substantially more light output for a given current. Unfortunately, the battery technology based on a voltage of approximately 1.5V per dry cell is again limited in that three dry cells in series, having a nominal voltage of 4.5V, are quickly drained to an actual applied voltage of less than 3.6V at which point the white light LED becomes inoperative even though the batteries still retain a substantial charge.

Conversely, rechargeable Nickel Cadmium battery packs having a nominal voltage of 4.5V are now commercially available. These rechargeable battery packs are not suitable for efficiently driving LEDs having forward bias voltages less than 4.5V.

Therefore, a need exists for an LED driver circuit which conditions all of the available power within the conventional dry cell battery for application to high voltage LEDs for personal lighting technology purposes.

BRIEF SUMMARY OF THE INVENTION

It is therefore an object of the present invention to provide a light emitting diode driving circuit which conditions the power available from conventional dry cell batteries for application to nonlinear, active lighting devices such as light emitting diodes.

It is a further object of the invention to achieve the above object in a circuit design occupying a small physical area for incorporation into an economical package.

It is yet another object of the invention to achieve the above objects in a circuit design which has a minimum of components and is therefore inexpensive to produce.

A first embodiment of the invention achieves the above objects and advantages, and other objects and advantages to be described further hereinbelow, by providing a light emitting device driver circuit having means for accepting a direct current from a power supply having a nominal voltage, an active light emitting device having a forward bias voltage less than the nominal voltage, and a converter circuit having an inductor and a unidirectional current blocking element interconnecting the power supply and the light emitting device. A first switch selectively and electrically communicates the inductor within the converter circuit to a ground so that the inductor can alternately be charged by the power supply and discharged through the light emitting device. A control means is operatively coupled with the first switch for charging and discharging the inductor. The control means also measures an instantaneous voltage and compares the instantaneous voltage to a pre-selected voltage threshold, indicative of an ability of the power supply to charge the inductor. The control means then adjusts a charging cycle duration of the inductor through the first switch so as to deliver substantially constant current to the light emitting device regardless of an actual voltage of the power supply. As used herein, the term "light emitting device" relates to an active device such as a light emitting diode, transistor, or other nonlinear device having a forward bias voltage which must be applied to induce the device to provide illumination.

In a second embodiment of the invention, a method for driving a light emitting diode includes closing a first switch so as to connect an inductor and a direct current power supply having a nominal voltage greater than a forward bias voltage of a light emitting diode to be driven to ground so as to charge the inductor; measuring an instantaneous voltage across a drain-source resistance of the first switch and comparing the instantaneous voltage to a pre-selected voltage threshold indicative of the ability of the power supply to charge the inductor; opening the first switch when the instantaneous voltage exceeds the pre-selected voltage threshold so as to direct current from the inductor through a blocking diode to the light emitting diode; and, after a brief time period closing the first switch again so as to provide substantially constant current to the light emitting diode regardless of an actual voltage of the power supply.

BRIEF DESCRIPTION OF THE SEVERAL VIEWS OF THE DRAWING(S)

DETAILED DESCRIPTION OF THE INVENTION

Figure 1:
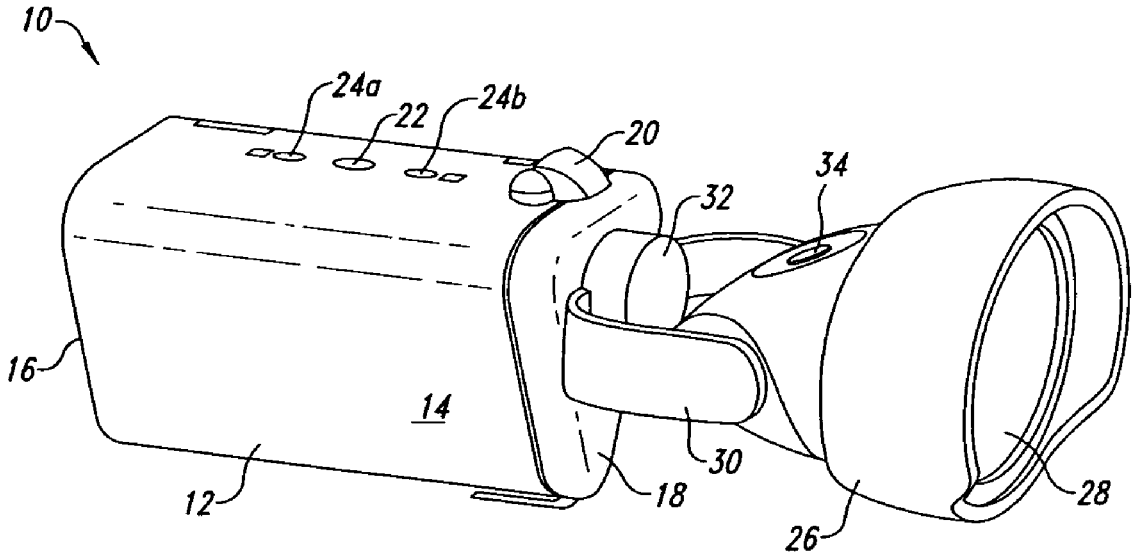
FIG. 1 is a perspective, environmental view of an exemplary convertible flashlight-headlamp employing the light emitting device driver circuit and method of the present invention.

A convertible flashlight-headlamp, employing a light emitting device driver circuit and method of the present invention, is generally indicated reference numeral 10 in FIG. 1. Mechanical characteristics of the convertible flashlight-headlamp are fully described in U.S. patent application entitled "CONVERTIBLE FLASHLIGHT-HEADLAMP" claiming priority from a provisional application of the same title filed on Nov. 16, 2001, Ser. No. 60/331,941 and assigned to the assignee of the instant application. For purposes of this disclosure, it is sufficient to state that the convertible flashlight-headlamp 10 has a triangular battery compartment 12 having three sides 14, a fixed end cap 16, and an openable end cap 18 pivotable about a hinge 20 for allowing selective access to the battery compartment.

As best seen in FIG. 1, the triangular battery compartment 12 is provided with a plurality of threaded receptacles 22, and pairs of external electrical contacts 24. The lamp assembly 26 has an LED (not seen in FIG. 1) behind a lens 28. The lamp assembly 26 is mechanically and electrically connected to the battery compartment 12 by an articulated yoke 30. The articulated yoke 30 has internal electrical conduits for connection with the external electrical contacts 24, and a knurled screw 32 for physically mating the yoke with the threaded receptacle 22 on the battery compartment 12. As will be appreciated by those of ordinary skill in the art, the correspond structure is provided on the openable end cap 18 and/or fixed end cap 16 so that the lamp assembly 26 can be repositioned in any of three locations on the triangular battery compartment 12. The lamp assembly 26 is also provided with a multifunction pushbutton switch 34 for operating the LED behind the lens 28 in a variety of different modes to be described further hereinbelow.

Figure 2:
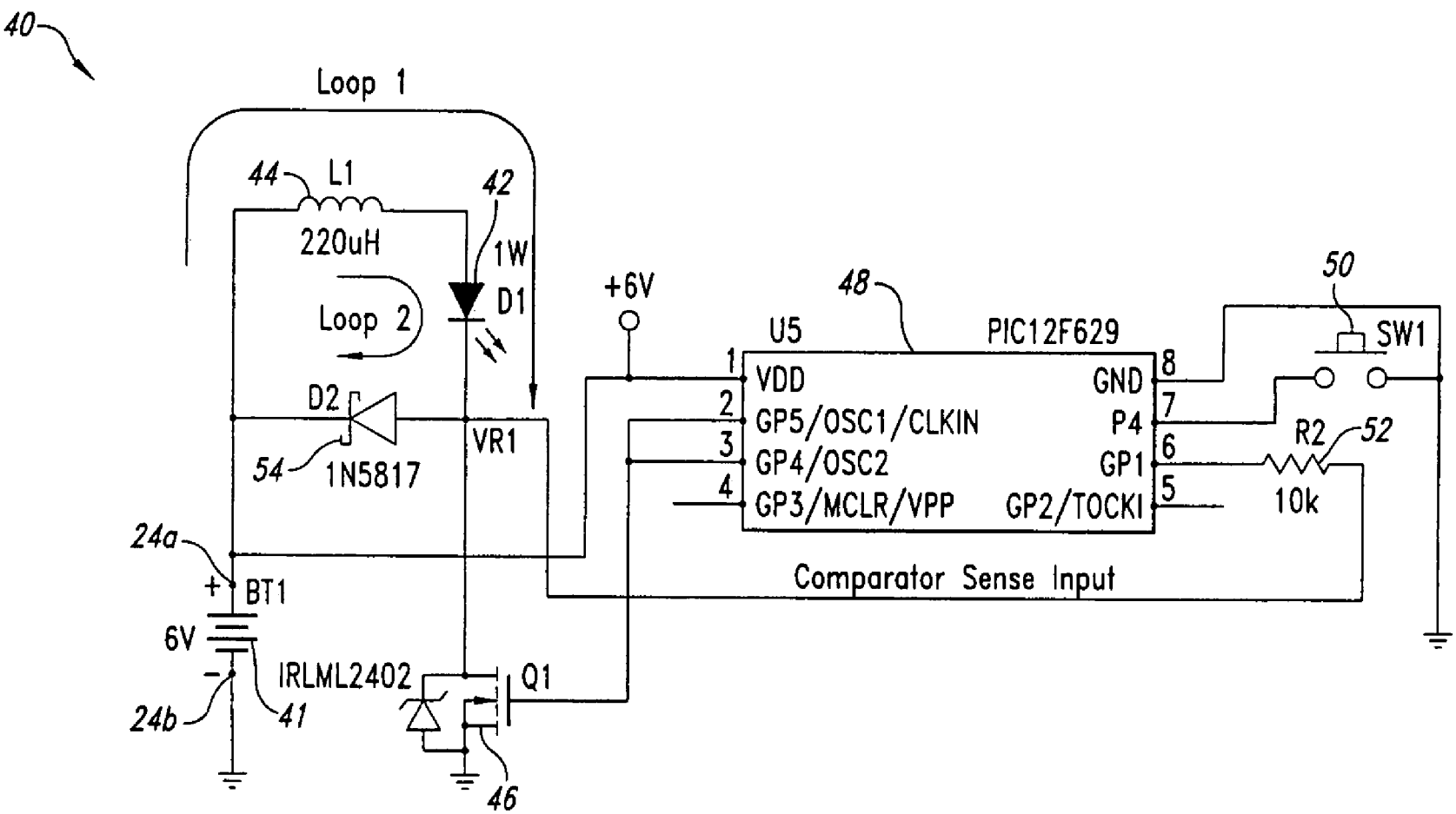
FIG. 2 is a schematic representation of a light emitting device driver circuit of a first embodiment of the invention.

A first embodiment of a light emitting device driver circuit is generally indicated at reference numeral 40 in FIG. 2. The circuit includes an LED 42, preferably a white light emitting diode having an output of approximately 1 watt and a forward bias voltage of approximately 3.1V to 3.6V. For example, an appropriate LED 42 is available from Lumileds, San Jose, Calif., U.S.A. under the brand name Luxeon Star. Voltage from the power supply 41 within battery compartment 12 is available at terminals 24*a* and 24*b* and has a nominal voltage of approximately 6V. The power supply is preferably a four 1.5V AA cell rechargeable power supply. The nominal voltage of the power supply is thus greater than the forward bias voltage of LED 42 and, therefore, circuit 40 functions as a step-down switching regulator. An inductor 44 has an inductance of approximately 220 μH and is connected between the positive power supply 24*a* and an input of the LED 42. The inductor 44 is used as a charging device to provide a substantially constant current to the LED 42. A first switch 46, preferably in the form of a depletion mode, n-channel field effect transistor (hereinafter 'FET') is provided to selectively connect the LED 42 to ground. The drain of the FET 46 is connected to an output of the LED 42, and the source of the FET 46 is connected to the ground 24*b*. The gate of the FET 46 is connected to pins 2 and 3 of a logic control device 48, preferably in the form of an 8-bit programmable micro-controller. For example, an appropriate micro-controller is manufactured by Microchip, Chandler, Ariz., U.S.A. with a model number PIC 12F629 and has 8 pins numbered in the conventional manner. As stated above, the gate of the FET 46 is connected to pins 2 and 3 (general purpose pins 5 and 4) of that micro-controller in a preferred embodiment. Pin 1 is connected to the positive power supply 24*a* while pin 8 is connected to the ground 24*b*. Pin 7 is connected through a power switch 50 to ground, where closing the power switch 50 turns on the micro-controller. Pin 6 (general purpose pin 1) is connected to the drain of the FET 46 through a current limiting resistor 52, which has a resistance of approximately 10 kΩ. A flyback diode 54 is preferably a Schottky-barrier diode having a forward bias voltage of approximately 0.2V. The diode 54 is connected so that an anode of the diode 54 is connected to the output of the LED 42, and a cathode output of the diode 54 is connected to an input of the inductor 44. The flyback diode 54 provides a discharge current path for the inductor 44.

General purpose pins (physical pins 2-7) of the micro-controller 48 are of the tristatable type, that is, these pins can be used as outputs (driven at CMOS logical high or low) or can be used as input pins which float like open circuits and can be intermittently connected through internal pull-up resistors to ground or to the supply voltage so that voltages can be measured at those pins. The invention employs pins 2 and 3 (general purpose pins 5 and 4) as outputs to turn the FET switch 46 on and off so that the inductor 44 can be alternately charged and discharged, and employs pin 6 (general purpose pin 1) as an input for measuring the voltage at the drain of the FET 46. In general, and as described more fully hereinbelow, the micro-controller 48 and FET switch 46 advantageously maintain a current flow through the LED 42 in a desired range of 0.4 A to 0.5 A (see FIG. 3) which optimizes both the light output of the LED and the current drain from the power supply 41.

When the FET 46 is turned on by the micro-controller 48 (initiated by depressing the power switch 50), the inductor 44 begins to charge and current begins to flow through the inductor 44, the LED 42 and the FET 46 (drive mode). Thus, the LED is now illuminated and a current of approximately (initially) 0.4 A flows therethrough. It is well known to those of ordinary skill in the art that all field effect transistors have an inherent internal resistance. A drain-to-source resistance is a known and fixed characteristic of the geometry and chemistry of the field effect transistor which is provided by the manufacturer. The FET 46 has a drain-to-source resistance of approximately 0.2Ω. As the current through the FET 46 rises (up to a selected maximum of approximately 0.5 A), so does the voltage at the drain of the FET 46. When the micro-controller 48 senses a threshold voltage at the drain of the FET 46 (approximately 0.25V), the FET 46 is turned off, the diode 54 becomes forward biased and begins to conduct current (flyback mode). The inductor 44 begins to discharge and continues to provide decreasing current to the LED 42. When the micro-controller 48 senses a voltage at the drain of the FET 46 less than approximately 0.2V, the FET 46 is turned on and the diode 54 becomes reverse biased. The cycle then repeats itself. In this manner, a substantially constant current is supplied to the LED 42 regardless of the actual, instantaneous voltage of the power supply available at external electrical contacts 24*a* and 24*b*. In the alternative, rather than measuring a lower threshold voltage, a brief time period equal to the duration of the changing cycle (e.g., 11 μsec) can be measured by the micro-controller for the discharge (flyback) mode.

Figure 3:
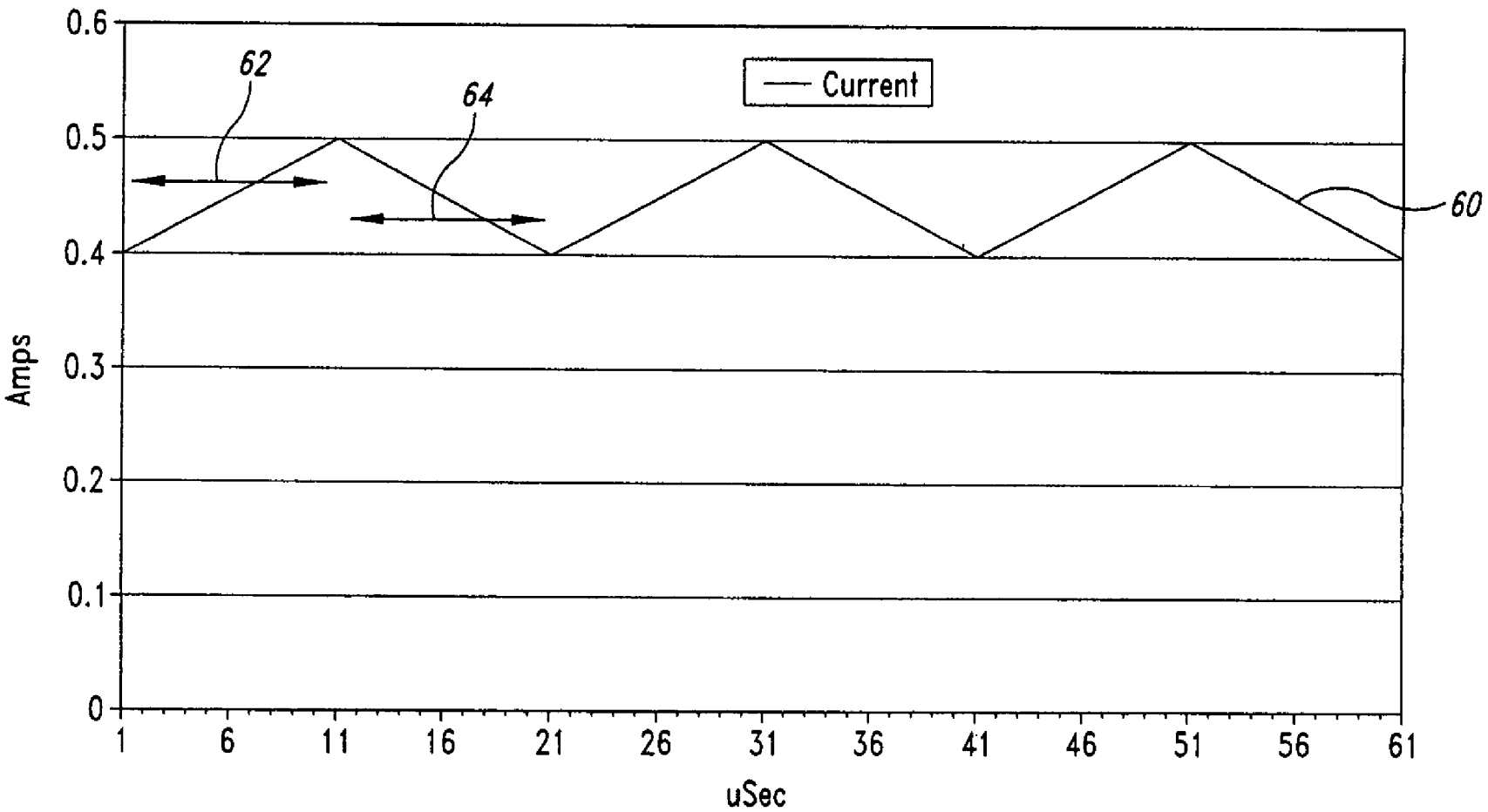
FIG. 3 is a graph illustrating a current supplied by an inductive element of the invention.
Figure 4:
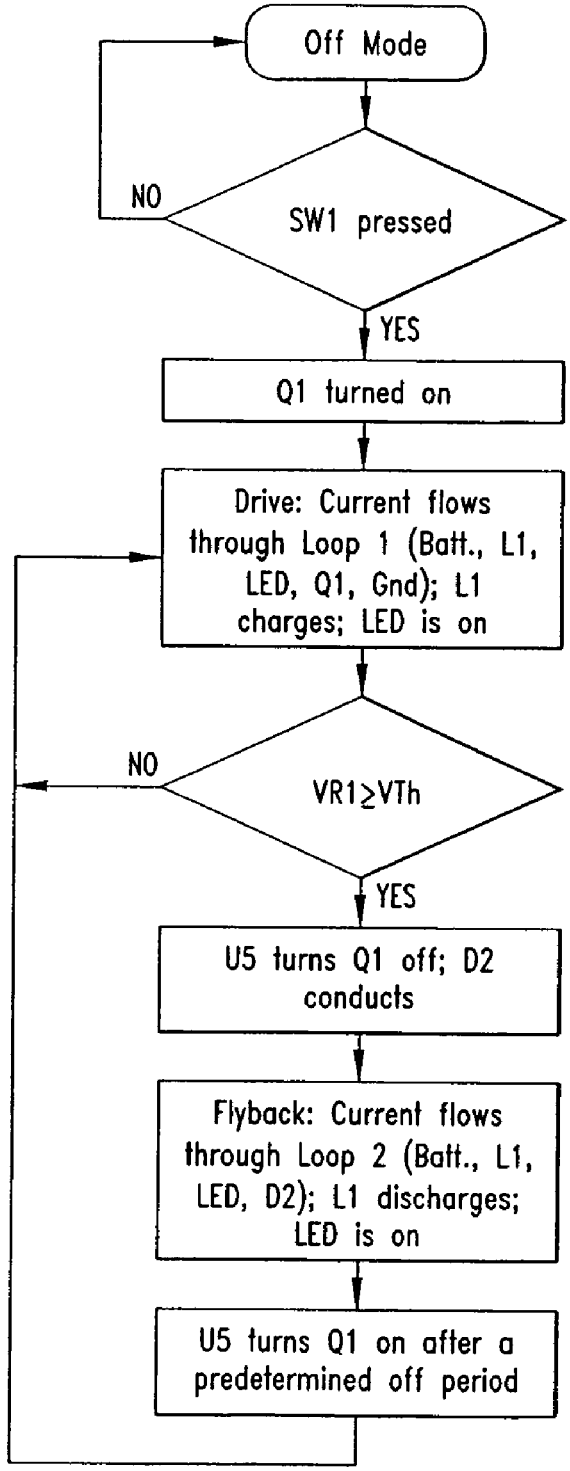
FIG. 4 is a flowchart illustrating a multistate logic diagram for a first embodiment of the invention including a power supply power measure display method of the invention.

FIG. 3 graphically represents the current (A) supplied to the LED 42 from the inductor 44 over time (μsec). A current waveform 60 is essentially a triangular wave having a first charge cycle 62 (drive mode) followed by a first discharge cycle 64 (flyback mode). As seen in FIG. 3, when micro-controller 48 turns on the FET 46 to charge the inductor 44 at the beginning of the first charge cycle 62, the current supplied by the inductor 44 increases linearly from a minimum of 0.4 A to a maximum current of approximately 0.5 A limited by the length of time which the micro-controller 48 permits the FET 46 to be on. When micro-controller 48 turns off the FET 46 to permit the inductor 44 to discharge at the beginning of the first discharge cycle 64, the diode 54 turns on and the current supplied by the inductor 44 decreases linearly to a minimum current of approximately 0.4 A limited by the length of time which the micro-controller 48 permits the FET 46 to be off. The cycle then repeats itself approximately every 22 μsec. As a result, an average current of approximately 0.45 A is supplied to the LED 42 with a variance of no greater than 50 mA. The method of providing a substantially constant current to the LED 42 is also shown in FIG. 4, which illustrates a logical diagram for the first embodiment of the invention.

Figure 5:
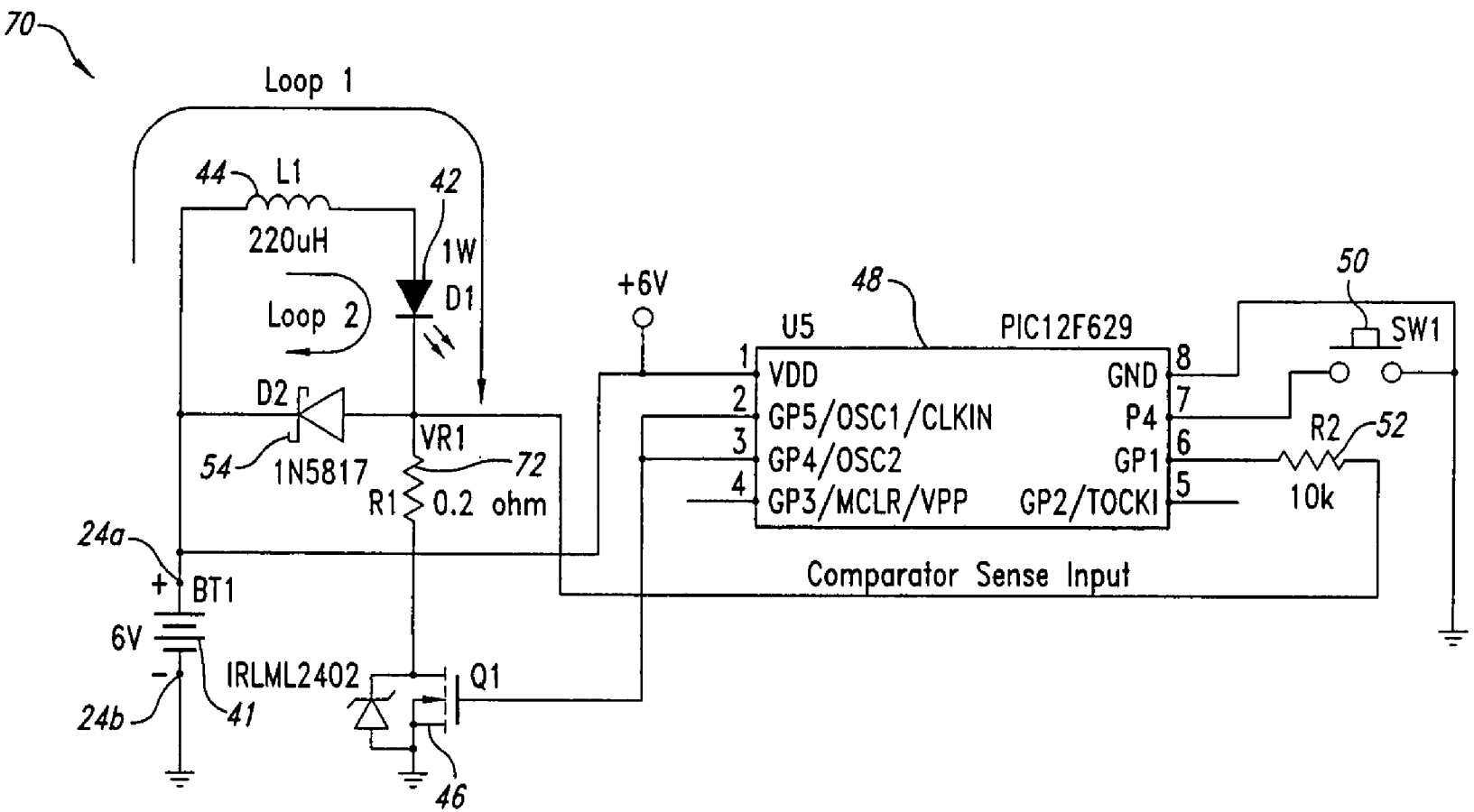
FIG. 5 is a schematic representation of a light emitting device driver circuit of a second embodiment of the invention.

A second embodiment of the invention is generally indicated at reference numeral 70 in FIG. 5. In this embodiment, the light emitting device driver circuit 70 has been modified so that a resistor 72 is connected between the output of the LED 42 and the drain of the FET 46. In addition, pin 6 (general purpose pin 1) of the multi-controller 48 is connected to the output of the LED 42. In this embodiment, the resistor 72 has a resistance of approximately 0.2Ω and the multi-controller 48 senses the voltage across the resistor 72 instead of the internal resistance of the FET 46 by adjusting the value of resistor 72. Different LEDs 42 having different forward bias voltages and different power supplies 41 having different nominal voltages can be used with the same micro-controller 48 measuring the same voltage thresholds with respect to the first embodiment.

Both the first embodiment 40 and the second embodiment 70 of the light emitting device driving circuit provide a number of advantages. Conventional switching regulators use an inductor to step down an input voltage to a lower output voltage which is then captured by an output filter capacitor. The invention, however, eliminates the need for expensive low-ESR capacitors by utilizing an inductor 44 to provide a substantially constant current directly to the LED 42. The first embodiment 40 has the additional advantages of utilizing the internal resistance of the FET 46 (versus using an external resistor) to sense the voltage and switch the FET 46. As a result, the first embodiment 40 not only uses one less component, but also utilizes a less expensive and lossier FET 46.

Those of ordinary skill in the art will conceive of other embodiments and variations of the invention in addition to those disclosed above. Thus, the invention is not to be limited by the above disclosure but is to be determined in scope by the claims which follow.

The invention claimed is:

1. A light emitting device driver circuit, comprising:

power supply means for accepting a direct current from a power supply having a nominal voltage;

an active light emitting device having a forward bias voltage less than the nominal voltage;

a converter circuit having an inductor and a unidirectional current blocking element interconnecting the power supply and the light emitting device;

a first switch for selectively electrically communicating the inductor to a ground so that the inductor can alternately be charged by the power supply and discharged through the light emitting device; and control means operatively coupled with the first switch for charging and discharging the inductor and for measuring an instantaneous voltage and comparing the instantaneous voltage to a pre-selected voltage threshold, indicative of an ability of the power supply to charge the inductor, so that a charging cycle duration of the inductor is adjusted through the first switch by the control means so as to deliver substantially constant current to the light emitting device regardless of an actual voltage of the power supply.

2. The light emitting device driver circuit of claim 1 wherein the first switch is a semiconductor device having a drain-source internal resistance and wherein the control means is a multistate micro-controller measuring the instantaneous voltage across the drain-source resistance, and comparing a pre-selected voltage threshold so as to switch off the first switch at a peak of the inductor's charging cycle.

3. The light emitting device driver circuit of claim 2 wherein the semiconductor device is an n-channel, depletion mode field effect transistor and the internal resistance is approximately 0.2 ohms.

4. The light emitting device driver circuit of claim 1, including a first resistive element electrically connected in series with the light emitting device and the first switch, operatively connected with the control means such that the control means can sample an instantaneous voltage across the first resistive element and the first switch supplied by the inductor during discharge for comparison to the pre-selected voltage threshold and for turning the first switch off.

5. The light emitting device driver circuit of claim 1 wherein the active light emitting device is a light emitting diode.

6. The light emitting device driver circuit of claim 1 wherein the unidirectional current blocking element is a Schottky diode.

7. A method for driving a light emitting diode, comprising the steps of:

closing a first switch so as to connect an inductor and a direct current power supply having a nominal voltage greater than a forward bias voltage of a light emitting diode to be driven to ground so as to charge the inductor;

measuring an instantaneous voltage across a drain-source resistance of the first switch and comparing the instantaneous voltage to a pre-selected voltage threshold indicative of the ability of the power supply to charge the inductor;

opening the first switch when the instantaneous voltage exceeds the pre-selected voltage threshold so as to direct current from the inductor through a blocking diode to the light emitting diode; and after a brief time period closing the first switch again so as to provide substantially constant current to the light emitting diode regardless of an actual voltage of the power supply.

8. The method of claim 7 wherein the first switch is a field effect transistor having a drain-source resistance and the measuring step is performed by a micro-controller having at least one multi-state input/output connected to a drain of the transistor and wherein the micro-controller measures an instantaneous voltage across the drain-source resistance of the field effect transistor until a pre-selected threshold voltage is attained.

9. The method of claim 7 wherein the threshold voltage is measured across a first resistive element electrically coupled in series to the drain source resistance of the field effect transistor and the drain-source resistance.

* * * * *